US006758410B2

(12) United States Patent
Kuo

(10) Patent No.: US 6,758,410 B2
(45) Date of Patent: Jul. 6, 2004

(54) RETAINING SUPPORTER OF ROTARY SPRINKLER

(76) Inventor: Wen-Li Kuo, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/016,405

(22) Filed: Dec. 17, 2001

(65) Prior Publication Data

US 2003/0111550 A1 Jun. 19, 2003

(51) Int. Cl.[7] ..... A62C 31/22
(52) U.S. Cl. ..... 239/276
(58) Field of Search ..... 239/273, 276, 239/280

(56) References Cited

U.S. PATENT DOCUMENTS 4,552,307 A * 11/1985 Stedham ..... 239/57
5,158,231 A * 10/1992 Christen et al. ..... 239/276
5,549,262 A * 8/1996 Whitehead ..... 248/87
6,250,565 B1 * 6/2001 Ogie et al. ..... 239/211

* cited by examiner

*Primary Examiner*—Lisa A. Douglas

(57) ABSTRACT

A retaining supporter of a rotary sprinkler is disclosed. The retaining supporter has a cruciform cylindrical base at the lower half of the rotary sprinkler. Two plates with equal length are crossed with each other so as to form a cylindrical member with a cruciform cross section. The width of one plate is thicker than the other one, and the vertical surface of the wider plate is a curved surface and has a shape like an inverted triangle. When the lower half section of the fixing supporting element in inserted into the soil, it can be inserted easily. When the top section of the rotary sprinkler is connected with water pipe for water flow, the water flows through the interior of the fixing supporting element of the rotary sprinkler, so that water can be sprayed from the water outlet of the rotary sprinkler and moves the rotary sprinkler.

1 Claim, 6 Drawing Sheets

RETAINING SUPPORTER OF ROTARY SPRINKLER

BACKGROUND OF THE INVENTION

1. Field of the Invention

The present invention relates to a retaining supporter for rotary sprinkler, more particularly to a fixing supporting element which will not loosen by the swing of the rotary movement of the rotary sprinkler as the lower half thereof is inserted into the soil, and thus the sprinkler can provide a reliable irrigating effect.

2. Description of the Prior Art

In general, a conventional retaining supporter for rotary sprinkler (referred to FIGS. 1, 2, and 3) comprises an inverted T-shaped water passage being disposed inside the top section of the fixing supporting element (which is a prior-art structure and will not be described herein), such that an inflow connector 21 is disposed at an end of the horizontal water passage, and a regular nut 221 is mounted to the other end. It will be connected to a water pipe or a connector 22 for water flow for other horticultural devices if necessary. The outlet end 23 of the vertical water passage is coupled to the bottom Al of the rotary sprinkler A, and the lower half section of the fixing supporting element 2 comprises two plates 241, 242 of equal length and being crossed with each other to form a tapered cylindrical member 24 with a cruciform cross section(as shown in FIG. 3).

As the aforementioned structure is assembled, and when the top section of the fixing supporting element 2 and the rotary sprinkler A are assembled, the swinging range of the rotary module A2 of the rotary sprinkler is adjusted according to the range of water spray for the horticulture. By means of a tapered cylindrical member 24 with a cross horizontal cross-section at the lower half section of the rotary sprinkler, the fixing supporting element 2 can be inserted into the soil B very easily. After the water pipe C is connected to the water flow and the water inflow connector 21 at the top section of the rotary sprinkler, the water flows through the interior of the top section of the fixing supporting element and enters into the outlet end at the top section in the interior of the rotary sprinkler A, such that the water will be sprayed out from the outlet A3 of the rotary sprinkler A and cause the rotary module A2 to move and also rotates for spraying (because of the rotary sprinkler, the structure of the rotary module A2 rotates for spraying water.The spraying range are within the scope of the prior-art, and thus it is not the claimed subject of this application. Therefore, the content of structure thereof will not be described herein.) Such rotary sprinkler enables the water to be sprayed to the land in the spraying range, and accomplishes the irrigation effect.

For the structure of the foregoing conventional fixing supporting element 2, its lower half section for inserting into the soil B is designed to as a tapered cylindrical member 24 having a cross-section of a cross shape, which comprising two plates 241, 242 of equal length. Furthermore, after the rotary sprinkler A coupled to the top section of the fixing supporting element 2 is mounted onto the top section of the fixing supporting element 2, the water flows through a lateral side of the inflow connector 21 at the top section of the fixing supporting element 2 and enters to the interior of the rotary sprinkler via the interior of the top section of the fixing supporting element 2, and finally sprays out from the outlet A3 of the rotary sprinkler A and brings the rotary module A2 of the rotary sprinkler to rotate for the water spray and attains the effect of obtaining water moisture. However, the soil at the location where rotary sprinkler A is inserted, will be moist due to the spray of the water. It will affect the water spray process of the rotary sprinkler A when it is connected to a water source. Since the back and forth movement of the rotary module A2 controls the movement of the rotary sprinkler for spraying water, the top section of the fixing supporting element 2 will be influenced by the back and forth movement of the rotary module A2 of the rotary sprinkler A coupled to its top section, and causes its lower half section being inserted into the soil with a tapered cylindrical member 24 having a cruciform cross section, and such cylindrical member 24 is made of two plates 241, 242 of equal length, such that it is unable to stop the back and forth rotational force generated during the water discharge process in the rotation movement of the rotary module. It results in shaking and vibration, and the original set spraying range of the whole rotary sprinkler A will be changed such that some of the unintended areas will be sprayed. On the contrary, some of the intended areas are not sprayed. More seriously, the entire fixing supporting element will be detached from the ground completely, and it has to be improved.

Therefore, the primary objective of the present invention is to provide a retaining supporter of a rotary sprinkler, such that when the lower half section of the fixing supporting element is inserted into the soil, the fixing supporting element will not be loosened due to the rotation movement of the rotary module of the sprinkler, and gives us a secure structure.

To make it easier for our examiner to understand the objective of the invention, structure, innovative features, and performance, we use a preferred embodiment together with the attached drawings for the detailed description of the invention.

BRIEF DESCRIPTION OF THE DRAWINGS

Other objects, features, and advantages of the invention will become apparent from the following detailed description of the preferred but non-limiting embodiment. The description is made with reference to the accompanying drawings, in which.

DESCRIPTION OF THE PREFERRED EMBODIMENT

Figure 1:
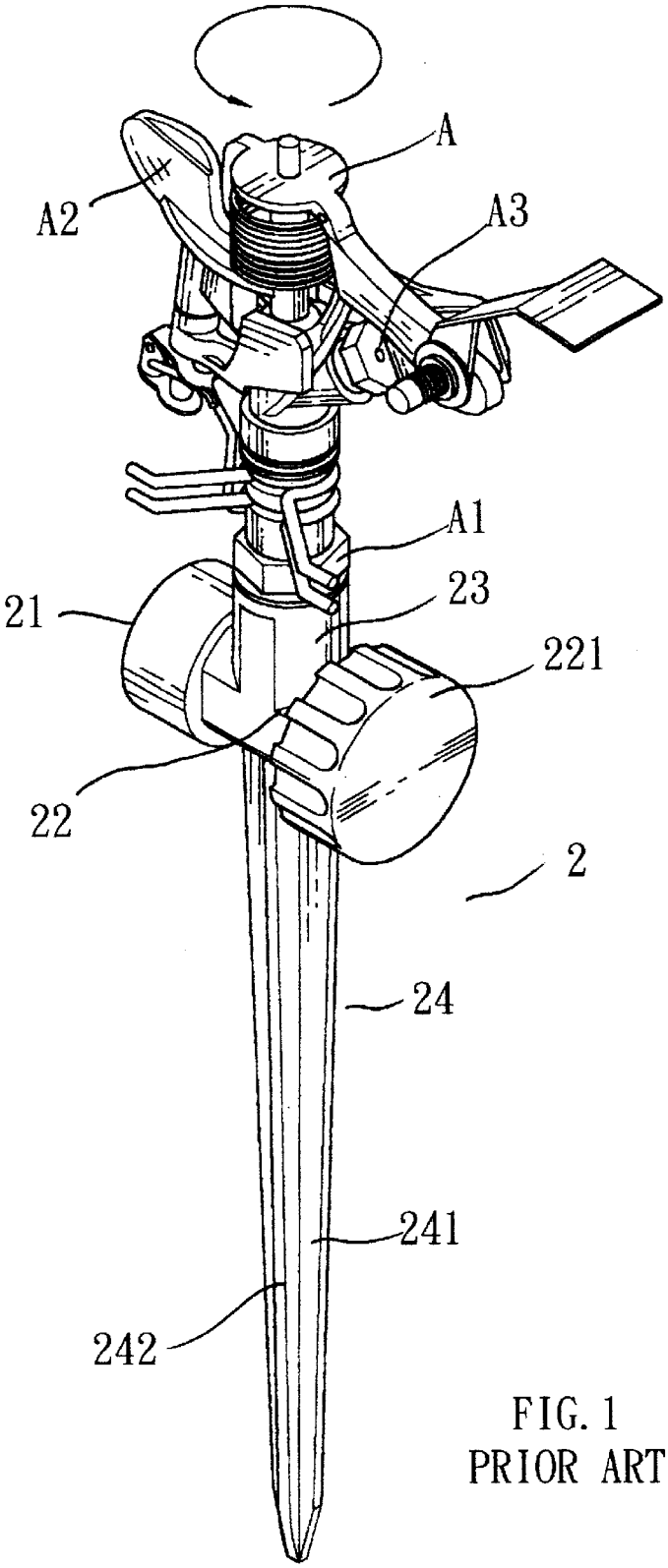
FIG. 1 PRIOR ART
FIG. 1 shows the 3-D appearance of a rotary sprinkler of the present invention.
Figure 2:
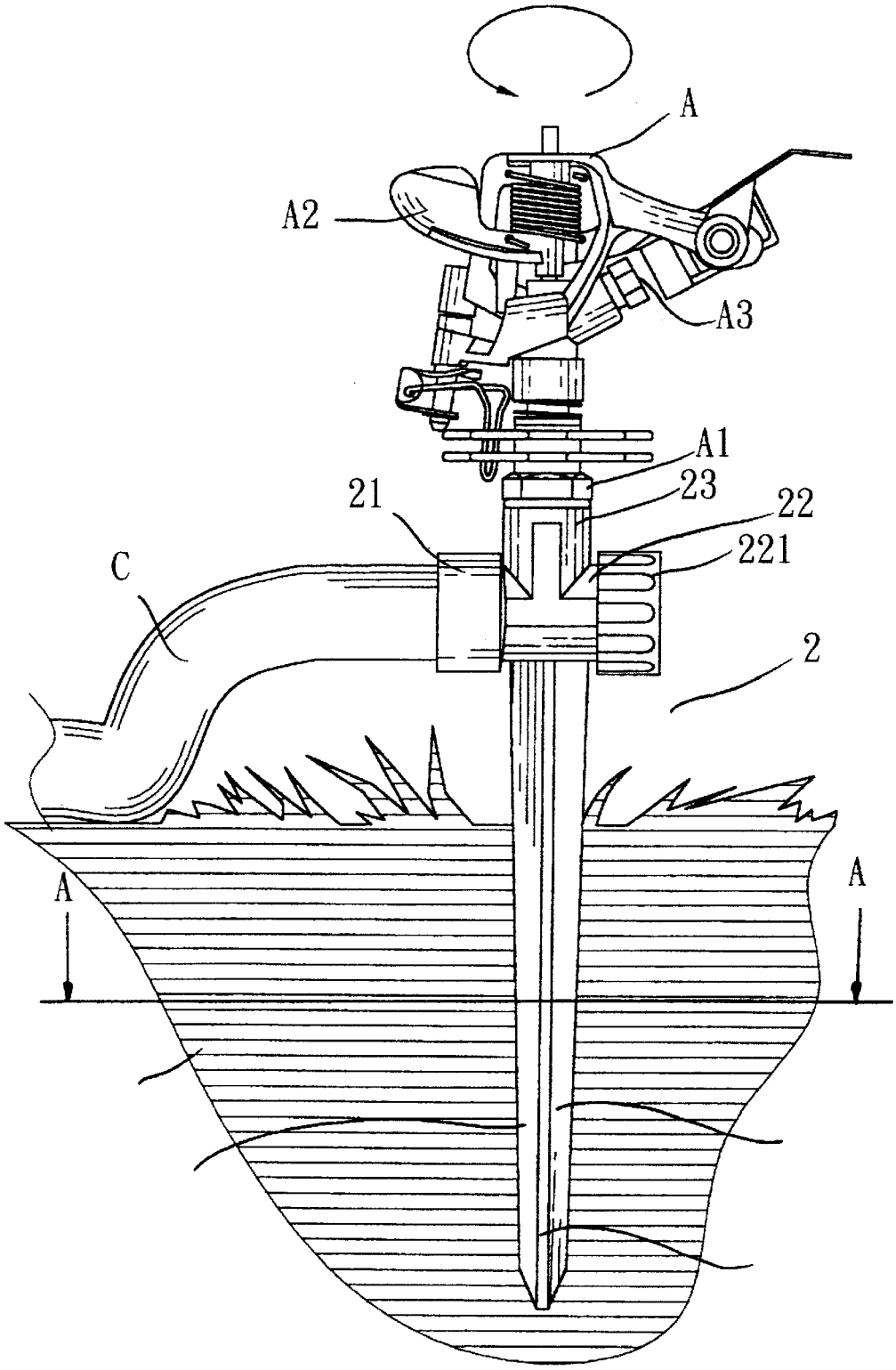
FIG. 2 PRIOR ART
FIG. 2 shows the operation of a prior-art structure.
Figure 3:
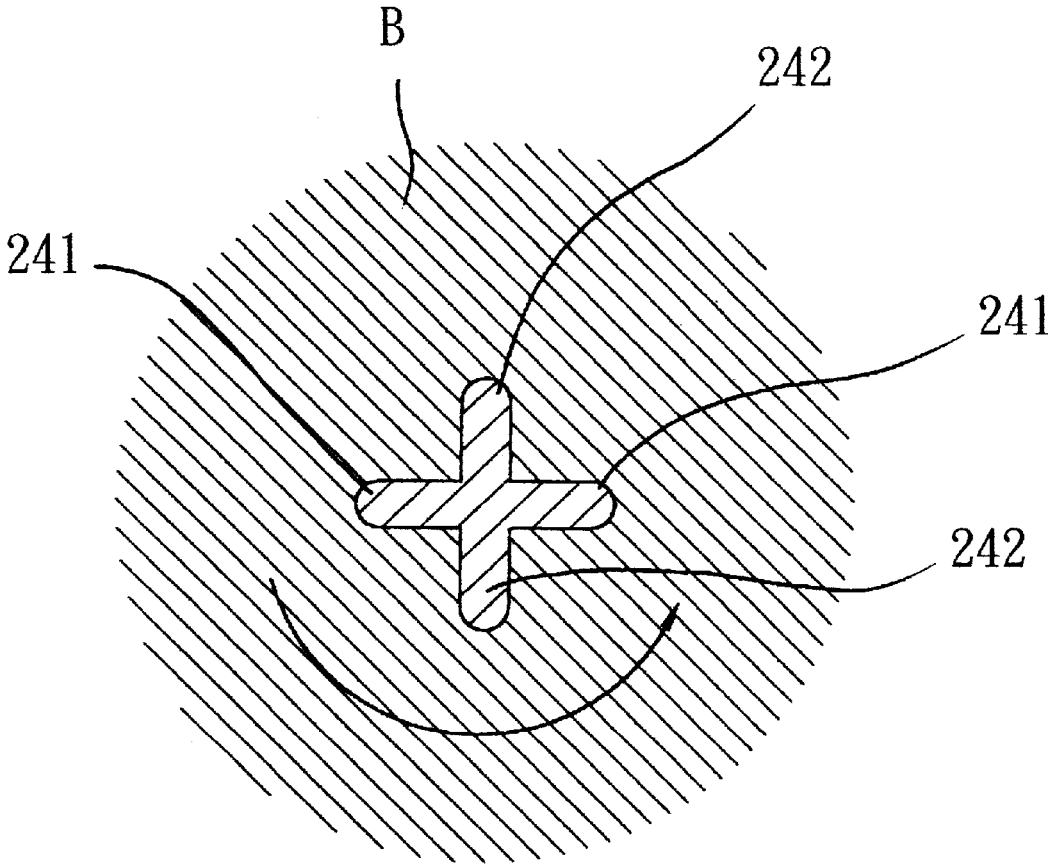
FIG. 3 PRIOR ART
FIG. 3 shows the horizontal cross sectional view (along line A—A) of a lower section of the fixing supporting element of the prior-art fixing structure illustrated in FIG. 2.
Figure 4:
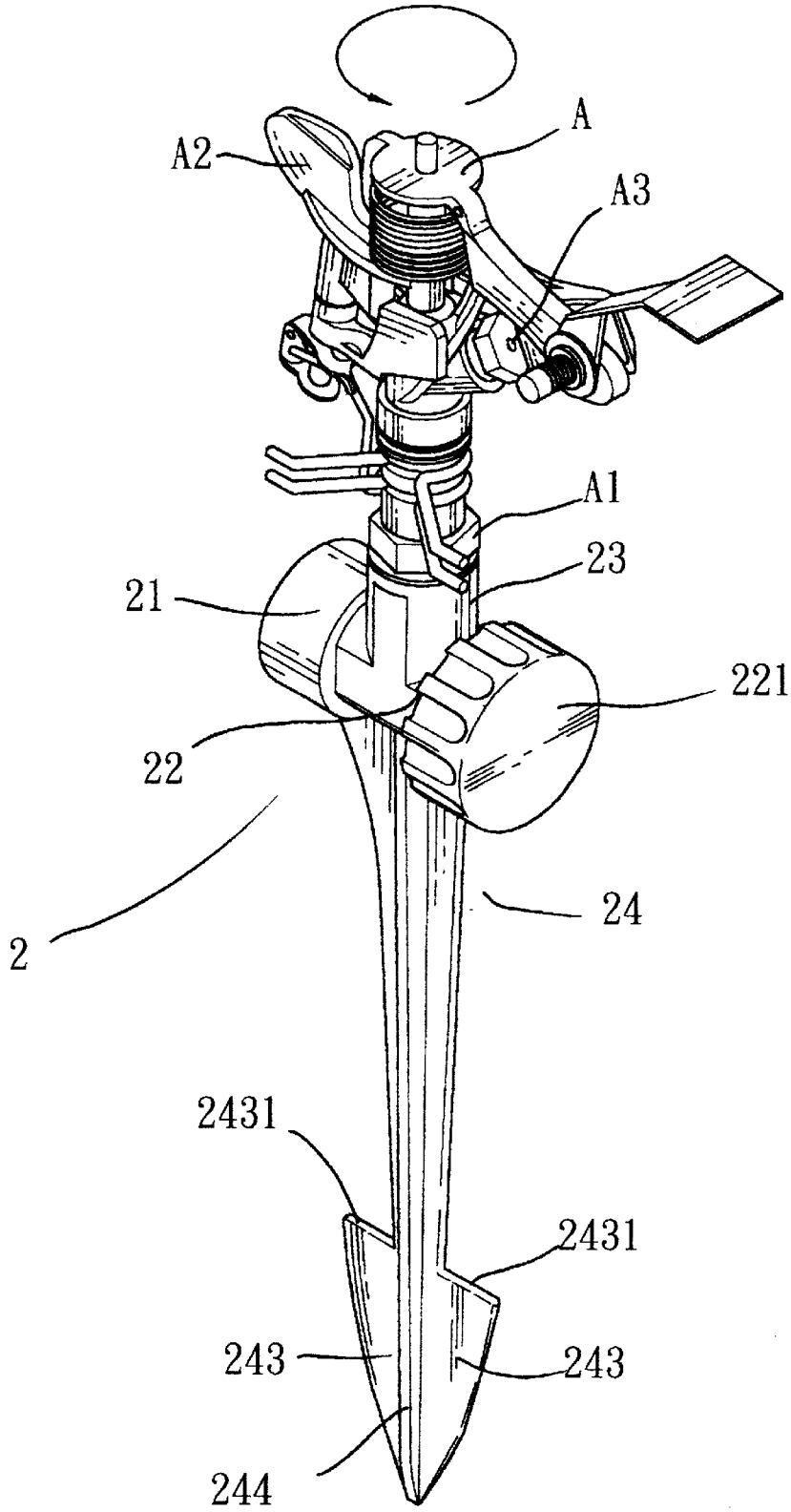
FIG. 4 shows 3-D appearance of the rotary sprinkler according to the present invention.
Figure 5:
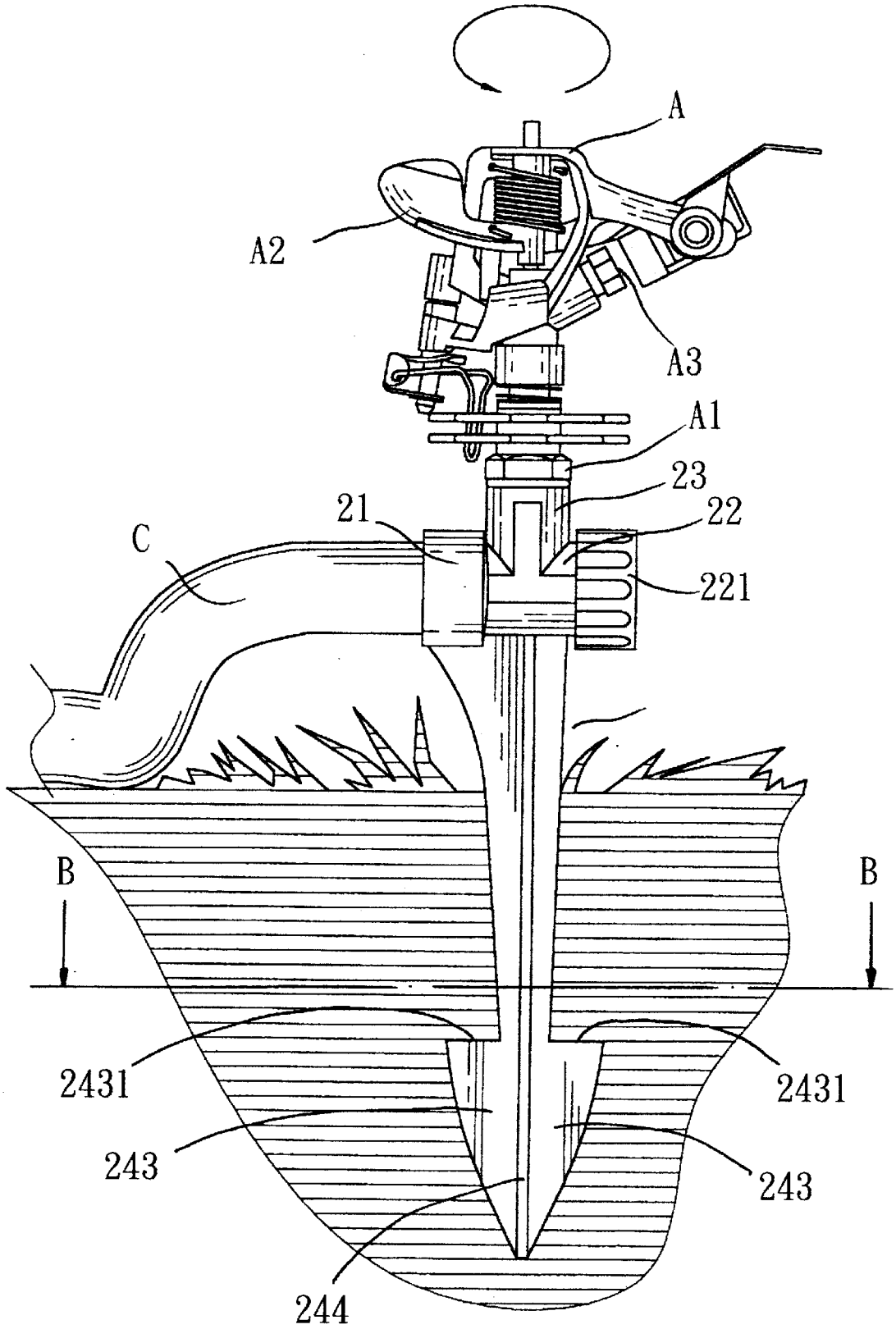
FIG. 5 shows the operation of the structure of the present invention.
Figure 6:
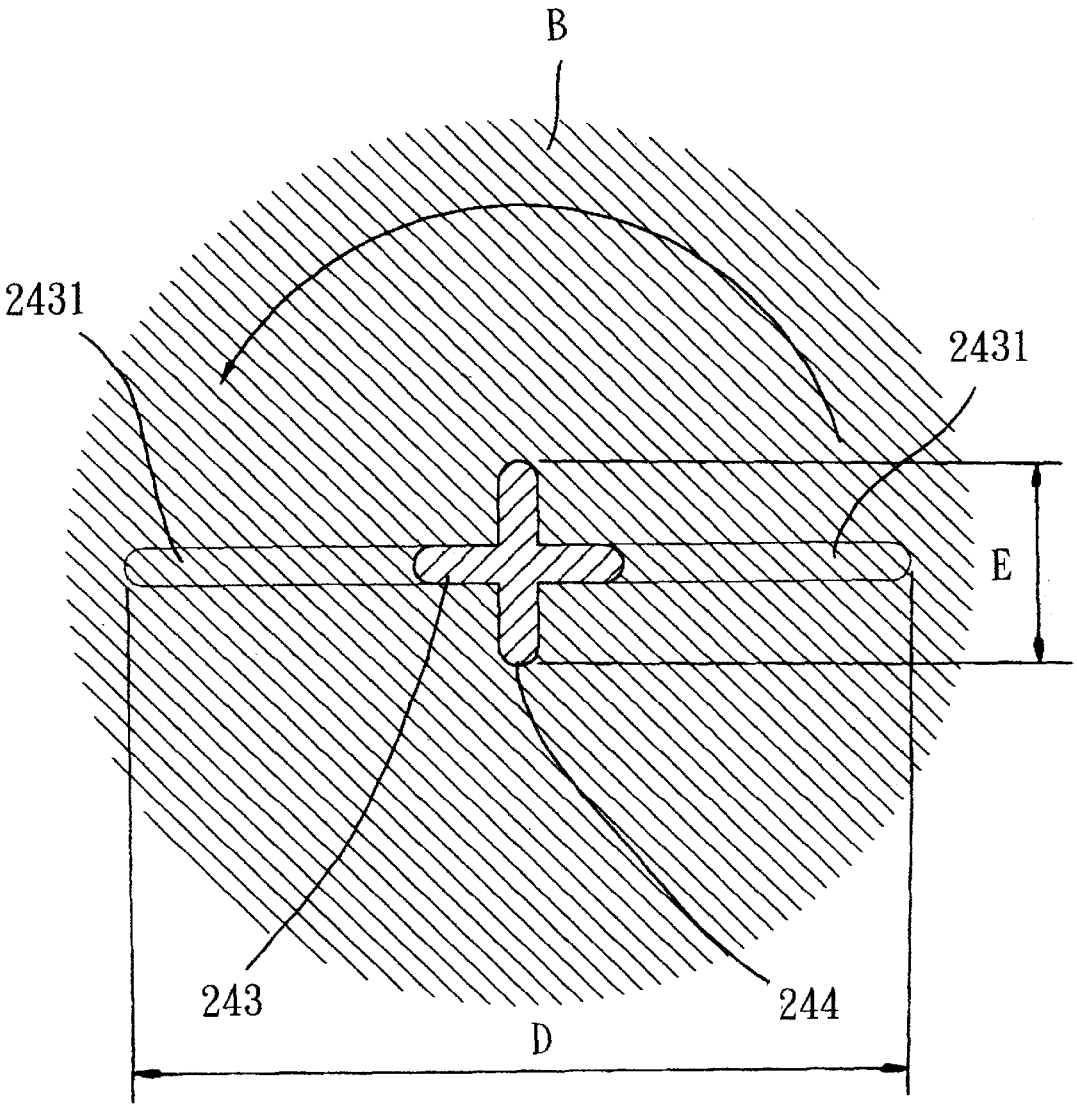
FIG. 6 shows the horizontal cross sectional view (along line B—B) of the lower section of the fixing supporting element of the structure according to the present invention.

Referring to FIGS. 4, 5, and 6, the retaining supporter of the rotary sprinkler of the present invention is illustrated in the drawings. The present invention comprises an inverted T-shape water passage (which is a prior-art structure and will not be described further) such that an inflow connector 21 is disposed at an end of the horizontal passage, and a regular nut 221 being disposed at and fixed to the other end. It is connected to a water pipe or a connector 22 for water flow for other horticultural devices if necessary. The outlet end 23 of the vertical water passage is coupled to the bottom Al of the rotary sprinkler A, and the lower half section of the fixing supporting element 2 comprises two plates 243, 244 of equal length and being crossed with one another to form a tapered cylindrical member 24 with a cruciform cross-section.

The present invention is characterized in that the tapered cylindrical member 24 made by the two plates 243, 244 of equal length and being crossed with each other and the width D of the plate 243 at the lower half section is set to be larger than the width E of the plate 244 (as shown in FIG. 6), and the whole vertical surface of a wider plate 243 is an inverted triangle and has cambered surfaces. After foregoing structure is assembled and the lower section of the fixing supporting element 2 of the rotary sprinkler is inserted into the soil B, the fixing supporting element can be inserted into the soil B easily. When the water pipe C is connected to the water source and the inlet connector 21 at the top section of the fixing supporting element, the water flows into the interior at the top section of the fixing supporting element 2, and then into the interior at the top end of the outlet end 23 of the rotary sprinkler A. Finally, the outlet A3 of the rotary sprinkler A sprays out water and brings the rotary module A2 of the rotary sprinkler A to rotate and spray water, such that the land within the spraying range is sprayed. In the moist procedure, the tapered cylindrical member 24 with a cruciform cross section is formed by crossing two plates 243, 244 of equal length, so that the width D of the plate 243 at the bottom part of the lower section is wider than the width E of the plate 244. The entire vertical surface of the wider plate 243 is a cambered plane and has a shape of an inverted triangle. Thereby, it can effectively stop the rotary sprinkler A coupled to the top of the fixing supporting element. As rotating the rotary module A2 for spraying water, the rotational force from the back and forth movement will not shake and loosen the fixing supporting element, but keeps the fixing supporting element in the soil B, and gives a secure effect.

Furthermore, after the lower section of the entire fixing supporting element 2 is inserted into the soil B, the water will be sprayed once in a certain time interval and by means of rotary movement of the rotary sprinkler A, such that the land can be irrigated in the range of the spraying water. In the process of the rotation and spraying, each time it also sprays water to the soil in area around the fixing supporting element A. The permeated moisture can secure the periphery of the fixing supporting element more and more, and thus makes the width D of the bottom part of the lower section of the fixing supporting element has a top surface 2431 of the plate 243 with a larger width D, and due to the filling of the soil (as shown in FIG. 6), it forms a resisting surface on the top surface 2431 to prevent any upward vibration or loosening. The lower section of the fixing supporting element 2 after being inserted into the soil, it can be secured and accomplishes the secure effect of not being loosened.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A retaining supporter for rotary sprinkler comprising a water passage; the water passage has a horizontal section and a vertical section which are formed of a shape like an inverted 'T', being disposed in an interior of a top section of a fixing supporting element, wherein an inlet water connector being disposed at an end of the horizontal section of the water passage, and a nut being mounted onto the other end of said horizontal section; a water outlet end of the vertical section of the water passage is mounted to a bottom end of a rotary sprinkler, and a lower section of the vertical section of the water passage is a tapered cylindrical member made by two plates which cross over one another, so that the tapered cylindrical member has a cruciform cross section, and is disposed at a lower half section of the fixing supporting element, and a width of one plate located at the bottom part of the lower section of the tapered cylindrical member is wider than that of the other plate, and an entire vertical surface of the wider plate is a curved plane and has an inverted triangle shape;

wherein by means of the foregoing assembled structure, when the lower section of the fixing supporting element of the rotary sprinkler is inserted into the soil, the fixing supporting element will not be loosened due to the movement and vibration of the rotary module of the sprinkler and thus provides a secure structure.

* * * * *